US005390084A

United States Patent [19]

Ohtake et al.

[11] Patent Number: 5,390,084

[45] Date of Patent: Feb. 14, 1995

[54] ILLUMINATION DEVICE

[75] Inventors: Motoyuki Ohtake, Omiya; Koichi Ohshita, Tokyo, both of Japan

[73] Assignee: Nikon Corporation, Tokyo, Japan

[21] Appl. No.: 247,231

[22] Filed: May 23, 1994

[30] Foreign Application Priority Data

May 24, 1993 [JP] Japan ..... 5-144283
May 24, 1993 [JP] Japan ..... 5-144284

[51] Int. Cl.[6] ..... F21V 13/04

[52] U.S. Cl. ..... 362/16; 362/330; 362/339

[58] Field of Search ..... 362/16, 308, 309, 327, 362/330, 339

[56] References Cited

U.S. PATENT DOCUMENTS 3,428,800 2/1969 Levin et al. ..... 362/327
4,017,727 4/1977 Yamamoto ..... 362/16
4,234,906 11/1980 Schindler ..... 362/339
4,317,625 3/1982 Van Allen ..... 362/16
5,083,245 1/1992 Fray et al. ..... 362/339
5,160,192 11/1992 Sughwarf ..... 362/16

*Primary Examiner*—Richard R. Cole
*Attorney, Agent, or Firm*—Shapiro and Shapiro

[57] ABSTRACT

An illumination device of this invention includes a flash light source for radiating flash light, a reflector, arranged on a side opposite to an object with respect to the flash light source, for reflecting a light beam radiated from the flash light source, and a refractor for projecting a light beam directly radiated from the flash light source and a light beam reflected by the reflector toward the object. The refractor adopts a Fresnel lens having a rotation-symmetrical shape with respect to its lens optical axis, a surface, on the object side, of the Fresnel lens is a flat surface perpendicular to the lens optical axis, and the other surface of the Fresnel lens is a Fresnel surface. The optical axes of the flash light source and the reflector are coaxial with each other, and define the reference optical axis of the illumination device. The lens optical axis is tilted at a predetermined angle from the reference optical axis, and the lens center of the Fresnel lens is shifted by a predetermined distance from a lens intersection as an intersection between the reference optical axis and the Fresnel lens.

9 Claims, 9 Drawing Sheets

ILLUMINATION DEVICE

BACKGROUND OF THE INVENTION

1. Field of the Invention

The present invention relates to an illumination device and, more particularly, to an illumination device used in, e.g., a flash light emission apparatus used for taking a photograph.

2. Related Background Art

FIG. 16 is a schematic perspective view showing the arrangement of a camera comprising a conventional illumination device. The camera shown in FIG. 16 is constituted by a camera main body 6 comprising a phototaking lens 7 and an illumination device 10. In order to eliminate a red eye phenomenon (a phenomenon in which when the pupils of the eyes are open, a light beam emitted from the illumination device 10 is reflected by the fundi of the eyes, and the eyes are imaged in red), the illumination device 10 is aligned so that its optical axis 9 is sufficiently separated from an optical axis 8 of the phototaking lens 7. In general, when the camera main body 6 is viewed from the object side, the illumination device 10 is aligned at the right or left end of the camera main body 6, as shown in FIG. 16.

FIG. 17 is a schematic sectional view showing the arrangement of the illumination device shown in FIG. 16. Referring to FIGS. 16 and 17, the illumination device 10 comprises, e.g., a xenon tube 1 as flash light means for emitting flash light. A reflector 2 for reflecting a light beam radiated from the xenon tube 1 is arranged on the side opposite to an object with respect to the xenon tube 1.

On the other hand, on the object side with respect to the xenon tube 1, a Fresnel lens 3 for projecting a light beam directly radiated from the xenon tube 1 and a light beam reflected by the reflector 2 in the direction of an object is arranged. The Fresnel lens 3 has a rotation-symmetrical shape about its optical axis. A surface, facing the xenon tube 1, of the Fresnel lens 3 is a Fresnel surface, and the other surface is a flat surface perpendicular to the optical axis.

The optical axes of the xenon tube 1, the reflector 2, and the Fresnel lens 3 coincide with the optical axis 9 of the illumination device 10. In other words, these optical axes have a coaxial relationship with the optical axis 9.

Of light beams emitted from the xenon tube 1, a light beam propagating in a direction opposite to the object is reflected by the reflector 2 in the direction of the object, and is refracted by the Fresnel lens 3 to illuminate a phototaking range of the phototaking lens 7. On the other hand, of the light beams emitted from the xenon tube 1, a light beam propagating in the direction of the object is directly incident on the Fresnel lens 3, and is refracted by the Fresnel lens 3 to illuminate the phototaking range of the phototaking lens 7.

Although a spherical aberration is compensated by the Fresnel lens 3 shown in FIG. 17, a sine condition cannot be compensated (the Fresnel surface cannot simultaneously compensate the spherical aberration and the sine condition).

For this reason, in order to evenly and satisfactorily illuminate the phototaking range of the phototaking lens 7, as shown in FIG. 16, the optical axis 9 of the illumination device 10 is aligned to be parallel to the optical axis 8 of the phototaking lens 7, and as described above, the optical axes of the xenon lamp 1, the reflector 2, and the Fresnel lens 3 are caused to coincide with the optical axis 9 of the illumination device 10.

As described above, in the conventional illumination device, in order to evenly and satisfactorily illuminate the phototaking range of the phototaking lens, the optical axis of the Fresnel lens must be caused to coincide with the reference optical axis of the illumination device, and the flat surface of the Fresnel lens must be set to be perpendicular to the lens optical axis. For this reason, the design of the camera main body and, especially, the outer shape of the camera front surface (at the side of the phototaking lens), are considerably limited.

In other words, when the optical axis of the Fresnel lens is simply tilted from the reference optical axis of the illumination device or the flat surface of the Fresnel lens is simply tilted (inclined) from the plane perpendicular to the lens optical axis to give priority to design of the camera main body, the projection direction is offset vertically or horizontally. For this reason, the phototaking range of the phototaking lens cannot be evenly and satisfactorily illuminated, and uneven illumination occurs.

In order to eliminate the above-mentioned drawback, it is theoretically possible to design the surface, on the object side, of the Fresnel lens to be a spherical surface so as to compensate a sine condition, or to design the Fresnel lens not to have a rotation-symmetrical shape with respect to its optical axis so as to avoid the projection direction from being offset. However, it is difficult to achieve a process itself required for working the surface, on the object side, of the Fresnel lens to a spherical surface or for working the entire shape not to be a rotation-symmetrical shape, and it is also difficult to assure required working precision. For these reasons, it is impossible to take the above-mentioned countermeasures in practice.

SUMMARY OF THE INVENTION

The present invention has been made in consideration of the above situation, and has as its first aspect to provide an illumination device which substantially evenly and satisfactorily illuminate the phototaking range of a phototaking lens even when the optical axis of a Fresnel lens is tilted from the reference optical axis of the illumination device.

An illumination device according to the first aspect of the present invention, comprises flash light means for radiating flash light, reflection means, arranged on a side opposite to an object with respect to the flash light means, for reflecting a light beam radiated from the flash light means, and refraction means for projecting a light beam directly radiated from the flash light means and a light beam reflected by the reflection means toward the object. The refraction means comprises a Fresnel lens having a rotation-symmetrical shape with respect to its lens optical axis, a surface, on the object side, of the Fresnel lens is a flat surface perpendicular to the lens optical axis, and the other surface of the Fresnel lens is a Fresnel surface. The optical axes of the flash light means and the reflection means are coaxial with each other, and define the reference optical axis of the illumination device. The lens optical axis is tilted at a predetermined angle from the reference optical axis, and the lens center of the Fresnel lens is shifted by a predetermined distance from a lens intersection as an intersection between the reference optical axis and the Fresnel lens, so that the offset of the projection direction with respect to the reference optical axis due to the tilt of the lens optical axis is substantially compensated by that of the projection direction with respect to the reference optical axis due to the shift of the lens center.

In a preferable mode of the invention, assuming that a unit vector indicating the direction of the lens optical axis toward an object is represented by L, a unit vector indicating the direction of the reference optical axis toward the object is represented by K, a vector connecting between the lens intersection and the lens center is represented by M, and the focal length of the refraction means is represented by f, the vectors L, K, and M are present in a single plane, the vectors L and M are perpendicular to each other, and a dimensionless value $|M|\cdot(L\cdot K)/f$, which is a reference value expressed by the above-mentioned parameters, and is obtained by dividing, with the focal length f, a product of the magnitude $|M|$ of the vector M corresponding to the shift amount and an inner product $(L\cdot K)$ of the vectors L and K corresponding to the tilt amount, falls within a range defined between an upper-limit value for defining a limit beyond which the offset of the light projection direction due to the shift of the lens center becomes larger than that of the light projection direction due to the tilt of the lens optical axis, and a lower-limit value for defining a limit beyond which the offset of the light projection direction due to the tilt of the lens optical axis becomes larger than that of the light projection direction due to the shift of the lens center. More preferably, the upper-limit value is 0.2, and the lower-limit value is 0.03.

FIGS. 5 to 8 are a series of drawings for explaining the principle of the illumination device according to the first aspect of the present invention. FIG. 5 is an optical sectional view showing a case wherein a Fresnel lens is neither tilted nor shifted (decentered). In FIG. 5, the Fresnel lens is assumed to be a thin lens.

Referring to FIG. 5, a reference optical axis d coincides with a lens optical axis e. Therefore, the lens center of a Fresnel lens b coincides with a lens intersection as an intersection between the Fresnel lens b and the reference optical axis d. In other words, the lens optical axis e is not tilted from the reference optical axis d, and the lens center is not shifted from the reference optical axis d (or the lens intersection).

Therefore, rays r1 and r2 emitted from a flash light source a are refracted by the Fresnel lens b as refraction means, and evenly illuminate a region including the phototaking range of a phototaking lens. A virtual image c, formed by the Fresnel lens b, of the flash light source a is formed on the reference optical axis d, i.e., on the lens optical axis e.

Referring to FIG. 6, the lens optical axis e is tilted through an angle $\theta$ from the reference optical axis d, but the lens center is not shifted from the reference optical axis d (or the lens intersection). In this case, a position c' of the virtual image, formed by the Fresnel lens b, of the flash light source a is present on the reference optical axis d in a paraxial region. More specifically, the flash light source a has a height with respect to the Fresnel lens b (the length of a perpendicular drawn from the flash light source a to the lens optical axis e corresponds to an image height), and the virtual image has an image height (the length of a perpendicular drawn from the position c' to the lens optical axis e corresponds to the image height).

However, in the Fresnel lens b, a sine condition is not sufficiently compensated, as described above. For this reason, actual rays emitted from the flash light source a are imaged as if they were emitted from a position c separated by a distance $\Gamma$ from the reference optical axis d in place of the position c'. The position c is present on a perpendicular drawn from the virtual image c' to the lens optical axis e.

In this manner, the rays r1 and r2 emitted from the flash light source a are refracted by the Fresnel lens b, so that a virtual image is formed at the position c, and propagate in an illumination direction offset from the reference optical axis d by an angle $\gamma$. As a result, the illumination range is offset from the phototaking range of the phototaking lens, resulting in uneven illumination.

In FIG. 6, the offset angle $\gamma$ of the illumination direction (to be referred to as an "offset due to tilt" hereinafter) is expressed by the following formula (1) using an interval BC between the Fresnel lens b and the position c along the reference optical axis d, and the above-mentioned distance $\Gamma$:

$$\gamma=\tan^{-1}(\Gamma/BC) \qquad \text{Formula (1)}$$

Referring to FIG. 7, the lens optical axis e is parallel to the reference optical axis d and is not tilted, and the lens center is shifted by a distance $\Delta$ from the reference optical axis d. In this case, it can be considered that the flash light source a has a height $\Delta$ with respect to the lens optical axis e. If the imaging magnification of the Fresnel lens b as the refraction means is represented by $\beta$, the virtual image c has an image height $\beta\cdot\Delta$, as shown in FIG. 7. As described above, the rays r1 and r2 emitted from the flash light source a propagate in an illumination direction offset by an angle $\delta$ from the reference optical axis d. As a result, the illumination range is offset from the phototaking range of the phototaking lens, thus causing uneven illumination.

The offset angle $\delta$ (to be referred to as an "offset due to shift" hereinafter) is expressed by the following formula (2) using an interval AB between the flash light source a and the Fresnel lens b along the reference optical axis d, and the distance $\Delta$ of the lens optical axis e from the reference optical axis d:

$$\delta=\tan^{-1}(\Delta/AB) \qquad \text{Formula (2)}$$

FIG. 8 is an optical sectional view corresponding to an illumination device of the present invention. Referring to FIG. 8, the lens optical axis e is tilted by an angle $\theta$ from the reference optical axis d, and the lens center is shifted by the distance $\Delta$ from the reference optical axis d. In this case, if the vector L indicating the direction of the lens optical axis, the vector K indicating the reference optical axis, and the vector M connecting between the lens intersection and the lens center are present in a single plane, an offset angle $\alpha$ of the illumination range is expressed by the following formula (3) as a total sum of the offset $\gamma$ due to tilt and the offset $\delta$ due to shift described above:

$$\alpha=\gamma+\delta \qquad \text{Formula (3)}$$

As described above, when the offset $\gamma$ due to tilt is compensated by the offset $\delta$ due to shift, the illumination range of the phototaking range can be uniformly and satisfactorily illuminated.

In order to realize the basic principle of the invention, i.e., compensation of the offset $\gamma$ due to tilt by the offset δ due to shift, the present inventors introduced the following formula (4) including a dimensionless reference value:

$$V_L < |M| \cdot (L \cdot K)/f < V_U \quad \text{Formula (4)}$$

where L is the unit vector indicating the direction of the lens optical axis e toward an object, K is the unit vector indicating the direction of the reference optical axis d toward the object, M is the vector connecting between the lens intersection and the lens center, and f is the focal length of the Fresnel lens. Note that the vectors L, K, and M are present in a single plane, and the vectors L and M are perpendicular to each other.

In the dimensionless reference value $|M| \cdot (L \cdot K)/f$, the magnitude $|M|$ of the vector M corresponds to the distance between the lens intersection and the lens center, i.e., the shift amount, and the inner product $(L \cdot K)$ of the unit vectors L and K corresponds to a cosine with respect to the angle $\theta$ defined between the reference optical axis d and the lens optical axis e, i.e., $\cos\theta$, that is, the tilt amount. Therefore, $|M| \cdot (L \cdot K)$ is equal to the distance between the lens center and the reference optical axis.

In formula (4), $V_U$ is the upper-limit value for defining a limit beyond which the offset δ due to shift becomes larger than the offset γ due to tilt, and $V_L$ is the lower-limit value for defining a limit beyond which the offset γ due to tilt becomes larger than the offset δ due to shift. Therefore, when the dimensionless reference value falls within a range defined between the upper-limit value $V_U$ and the lower-limit value $V_L$, the offset γ due to tilt is substantially compensated by the offset δ due to shift, and the illumination range of the phototaking lens can be evenly and satisfactorily illuminated.

The present inventors conducted simulations and experiments based on possible variable parameters for existing illumination devices in addition to embodiments to be described below, and acquired and verified the finding that the lower-limit value was about 0.03 and the upper-limit value was about 0.2.

The second aspect of the present invention will be described below.

The second aspect of the present invention provides an illumination device which can substantially evenly and satisfactorily illuminate a phototaking range of a phototaking lens even when the flat surface of a Fresnel lens is tilted from a plane perpendicular to the lens optical axis.

An illumination device according to the second aspect of the present invention comprises flash light means for radiating flash light, reflection means, arranged on a side opposite to an object with respect to the flash light means, for reflecting a light beam radiated from the flash light means, and refraction means for projecting a light beam directly radiated from the flash light means and a light beam reflected by the reflection means toward the object. The refraction means comprises a Fresnel lens having a rotation-symmetrical shape with respect to its lens optical axis, a surface, on the object side, of the Fresnel lens is a flat surface tilted from a plane perpendicular to the lens optical axis, and the other surface of the Fresnel lens is a Fresnel surface. The optical axes of the flash light means and the reflection means are coaxial with each other, and define a reference optical axis of the illumination device. The lens optical axis is parallel to and is shifted by a predetermined distance from the reference optical axis, so that the offset of the projection direction with respect to the reference optical axis due to the tilt of the flat surface, on the object side, of the Fresnel lens is substantially compensated by that of the projection direction with respect to the reference optical axis due to the shift of the lens optical axis.

In a preferable mode of the invention, assuming that a unit vector indicating the direction of the lens optical axis toward an object is represented by L, a unit vector indicating the direction of the reference optical axis toward the object is represented by K, a vector for connecting between a Fresnel intersection as an intersection between the Fresnel surface of the Fresnel lens and the reference optical axis and a Fresnel center as an intersection between the Fresnel surface of the Fresnel lens and the lens optical axis is represented by M, a unit normal vector N passing a lens intersection as an intersection between the flat surface of the Fresnel lens and the lens optical axis, and indicating the normal to the flat surface of the Fresnel lens is represented by N, and the focal length of the refraction means is represented by f, the vectors L and K are parallel to each other, the vectors L, N, and K are present in a single plane, the vectors L and M are perpendicular to each other, and a dimensionless value $|M| \cdot (N \cdot K)/f$, which is a reference value expressed by the above-mentioned parameters, and is obtained by dividing, with the focal length f, a product of the magnitude $|M|$ of the vector M corresponding to the shift amount and an inner product $(L \cdot K)$ of the vectors N and K corresponding to the tilt amount, falls within a range defined between an upper-limit value for defining a limit beyond which the offset of the light projection direction due to the shift of the lens optical axis becomes larger than that of the light projection direction due to the tilt of the flat surface of the Fresnel lens, and a lower-limit value for defining a limit beyond which the offset of the light projection direction due to the tilt of the flat surface of the Fresnel lens becomes larger than that of the light projection direction due to the shift of the lens optical axis. More preferably, the upper-limit value is 0.25, and the lower-limit value is 0.05.

FIGS. 12 to 15 are a series of drawings for explaining the principle of the illumination device according to the second aspect of the present invention. FIG. 12 is an optical sectional view showing a case wherein a flat surface b1 of a Fresnel lens is perpendicular to a lens optical axis e, and the lens optical axis e is not shifted (decentered) from a reference optical axis d.

Referring to FIG. 12, the reference optical axis d coincides with the lens optical axis e. Therefore, rays r1 and r2 emitted from a flash light source a are refracted by a Fresnel lens b as refraction means, and evenly illuminate a region including the phototaking range of a phototaking lens. A virtual image c, formed by the Fresnel lens b, of the flash light source a is formed on the reference optical axis d, i.e., the lens optical axis e.

Referring to FIG. 13, although the lens optical axis e coincides with the reference optical axis d, the normal vector N of the flat surface b1 of the Fresnel lens, which vector passes the lens intersection, is tilted by an angle $\theta$ from the lens optical axis e. In this case, since the flat surface b1, on the object side, of the Fresnel lens b provides a prism function, the rays r1 and r2 emitted from the flash light source a propagate in an illumination direction offset from the reference optical axis d, as shown in FIG. 13. As a result, the illumination range is offset from the phototaking range of the phototaking lens, resulting in uneven illumination.

Referring to FIG. 13, an angle $\gamma$ defined between an axis connecting the virtual image c and the Fresnel center, and the reference optical axis d corresponds to the offset of the illumination direction. The offset angle $\gamma$ (to be referred to as an "offset due to tilt" hereinafter) is expressed by the following formula (5) using an interval BC between the Fresnel center of the Fresnel lens b and the virtual image c along the reference optical axis d, and a distance $\Gamma$ of the virtual image c from the reference optical axis d:

$$\gamma=\tan^{-1}(\Gamma/BC) \qquad \text{Formula (5)}$$

Referring to FIG. 14, the lens optical axis e is parallel to the reference optical axis d and is shifted therefrom by a distance $\Delta$. On the other hand, the flat surface b1 of the Fresnel lens b is perpendicular to the lens optical axis. In this case, it can be considered that the flash light source a has a height $\Delta$ with respect to the lens optical axis e. If the imaging magnification of the Fresnel lens b as the refraction means is represented by $\beta$, the virtual image c has an image height $\beta\cdot\Delta$, as shown in FIG. 14. As described above, the rays r1 and r2 emitted from the flash light source a propagate in an illumination direction offset by an angle $\delta$ from the reference optical axis d. As a result, the illumination range is offset from the phototaking range of the phototaking lens, thus causing uneven illumination.

The offset angle $\delta$ (to be referred to as an "offset due to shift" hereinafter) is expressed by the following formula (6) using an interval AB between the flash light source a and the Fresnel center of the Fresnel lens b along the reference optical axis d, and the distance $\Delta$ of the lens optical axis e from the reference optical axis d:

$$\delta=\tan^{-1}(\Delta/AB) \qquad \text{Formula (6)}$$

FIG. 15 is an optical sectional view corresponding to an illumination device of the present invention. Referring to FIG. 15, a normal W to the flat surface b1 of the Fresnel lens b, which normal passes the lens intersection is tilted by an angle $\theta$ from the lens optical axis e, and the lens optical axis e is shifted by a distance $\Delta$ from the reference optical axis d. In this case, when the vector indicating the direction of the lens optical axis, the vector indicating the reference optical axis, and the normal vector to the flat surface of the Fresnel lens are present in a single plane, an offset angle $\alpha$ of the illumination range is expressed by the following formula (7) as a sum total of the offset $\gamma$ due to tilt and the offset $\delta$ due to shift described above:

$$\alpha=\gamma+\delta \qquad \text{Formula (7)}$$

As described above, when the offset $\gamma$ due to tilt is compensated by the offset $\delta$ due to shift, the illumination range of the phototaking range can be uniformly and satisfactorily illuminated.

In order to realize the basic principle of the invention, i.e., compensation of the offset $\gamma$ due to tilt by the offset $\delta$ due to shift, the present inventors introduced the following formula (8) including a dimensionless reference value:

$$X_L<|U|\cdot(W\cdot S)/f<X_U \qquad \text{Formula (8)}$$

where S is the unit vector indicating the direction of the reference optical axis d toward an object, U is the vector connecting between the Fresnel intersection and the Fresnel center, W is the unit normal vector passing the lens intersection, and indicating the normal to the flat surface of the Fresnel lens, and f is the focal length of the Fresnel lens. Note that a unit vector indicating the direction of the lens optical axis e toward the object is represented by T, the vectors T and S are parallel to each other, the vectors T, W, and S are present in a single plane, and the vectors T and U are perpendicular to each other.

In the dimensionless reference value $|U|\cdot(W\cdot S)$, the magnitude $|U|$ of the vector U corresponds to the distance between the Fresnel intersection and the Fresnel center, i.e., the shift amount of the lens optical axis with respect to the reference optical axis, and the inner product $(W\cdot S)$ of the unit vectors W and S corresponds to a cosine with respect to the angle $\theta$ defined between the normal to the flat surface of the Fresnel lens and the lens optical axis e, i.e., the reference optical axis d, that is, $\cos\theta$, and to the tilt amount.

In formula (8), $X_U$ is the upper-limit value for defining a limit beyond which the offset $\delta$ due to shift becomes larger than the offset $\gamma$ due to tilt, and $X_L$ is the lower-limit value for defining a limit beyond which the offset $\gamma$ due to tilt becomes larger than the offset $\delta$ due to shift. Therefore, when the dimensionless reference value falls within a range defined between the upper-limit value $X_U$ and the lower-limit value $X_L$, the offset $\gamma$ due to tilt is substantially compensated by the offset $\delta$ due to shift, and the illumination range of the phototaking lens can be evenly and satisfactorily illuminated.

The present inventors conducted simulations and experiments based on possible variable parameters for existing illumination devices in addition to embodiments to be described below, and acquired and verified the finding that the lower-limit value was about 0.05 and the upper-limit value was about 0.25.

DETAILED DESCRIPTION OF THE PREFERRED EMBODIMENTS

The preferred embodiments of the present invention will be described hereinafter with reference to the accompanying drawings.

Figure 1:
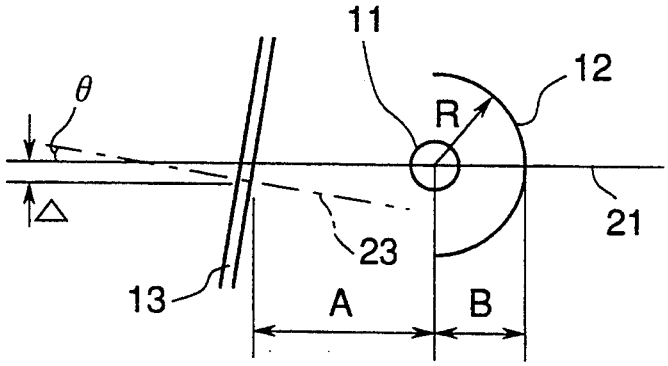
FIG. 1 is a view for explaining the arrangement of an illumination device according to an embodiment of the first aspect of the present invention.

FIG. 1 is a view for explaining the arrangement of an illumination device according to an embodiment of the first aspect of the present invention.

The illumination device of the present invention comprises, e.g., a xenon tube 11 as flash light means for emitting flash light. A reflector 12 for reflecting a light beam radiated from the xenon tube 11 is arranged on a side opposite to an object with respect to the xenon tube 11. The reflector 12 has a semi-cylindrical shape with a radius of curvature R, and is separated by a distance B from the center of the xenon tube 11.

A Fresnel lens 13 as refraction means for projecting a light beam directly radiated from the xenon tube 11 and a light beam reflected by the reflector 12 is arranged on the object side with respect to the xenon tube 11. The optical axes of the xenon tube 11 and the reflector 12 are coaxial with each other, and define a reference optical axis 21 of the illumination device.

Figure 2:
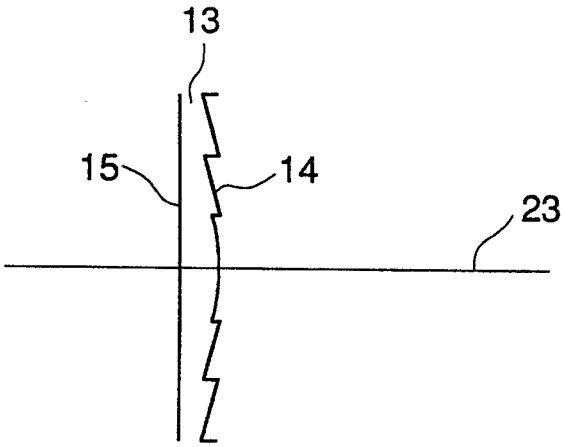
FIG. 2 is a sectional view of a Fresnel lens shown in FIG. 1.

FIG. 2 is a sectional view of the Fresnel lens 13 shown in FIG. 1. Referring to FIGS. 1 and 2, the Fresnel lens 13 has a rotation-symmetrical shape with respect to its lens optical axis 23, a surface, facing the xenon tube 11, of the Fresnel lens is a Fresnel surface 14, and the other surface is a flat surface 15. The distance between the Fresnel surface 14 of the Fresnel lens 13, and the center of the xenon tube 11 along the reference optical axis 21 is A.

The lens optical axis 23 of the Fresnel lens 13 is titled clockwise in FIG. 1 by an angle $\theta$ from the reference optical axis 21, and the lens center of the Fresnel lens 13 is shifted downward (FIG. 2) by a distance $\Delta$ from the reference optical axis 21.

Of light beams emitted from the xenon tube 11, a light beam propagating in a direction opposite to an object is reflected by the reflector 12 in the direction of the object, is refracted by the Fresnel lens 13, and illuminates the object. On the other hand, of light beams emitted from the xenon tube 11, a light beam propagating in the direction of the object is directly incident on the Fresnel lens 13, is refracted by the Fresnel lens 13, and illuminates the object.

Figure 3:
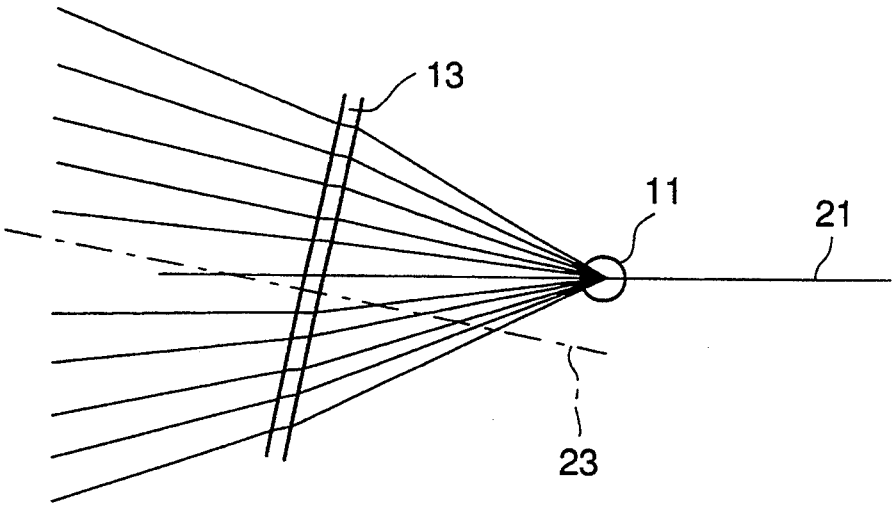
FIG. 3 is an optical sectional view showing the optical paths of rays emitted from a xenon tube in the illumination device of the embodiment shown in FIG. 1.
Figure 4:
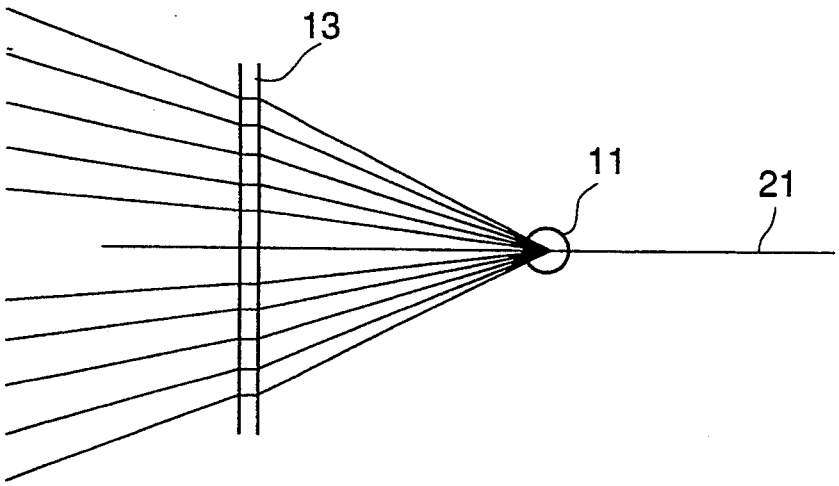
FIG. 4 PRIOR ART
FIG. 4 is an optical sectional view showing the optical paths of rays emitted from a xenon tube in a conventional illumination device in which a Fresnel lens is neither tilted nor shifted.
Figure 5:
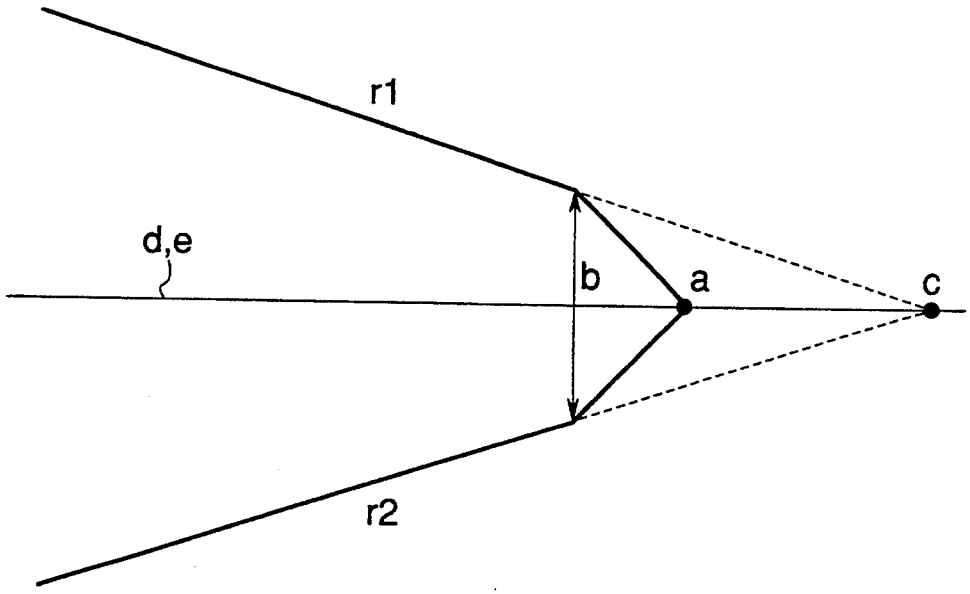
FIG. 5 is an optical sectional view corresponding to one of a series of drawings for explaining the principle of an illumination device according to the first aspect of the present invention, and showing a case wherein a Fresnel lens is neither tilted nor shifted.
Figure 6:
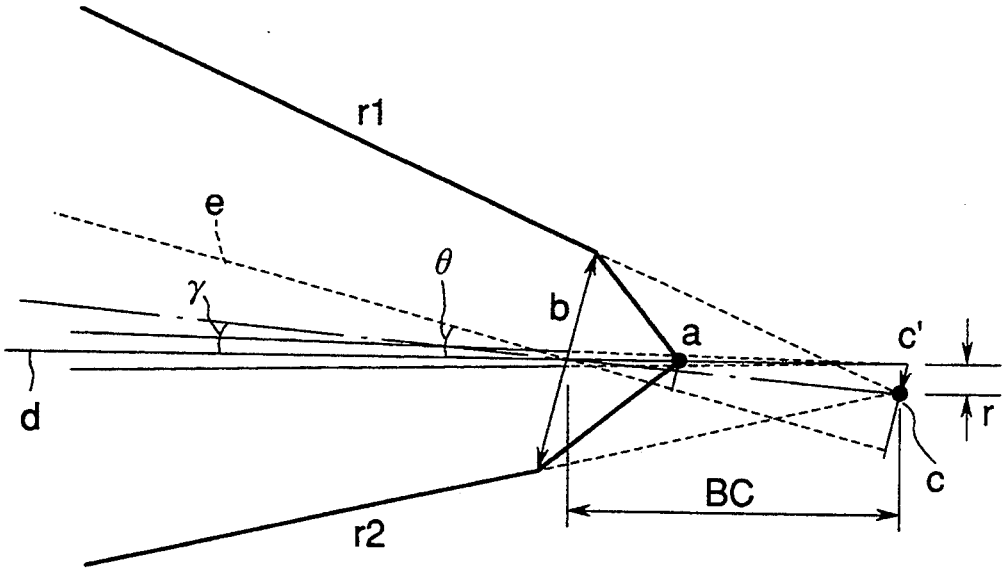
FIG. 6 is an optical sectional view corresponding to one of a series of drawings for explaining the principle of the illumination device according to the first aspect of the present invention, and showing a case wherein the Fresnel lens is only tilted.
Figure 7:
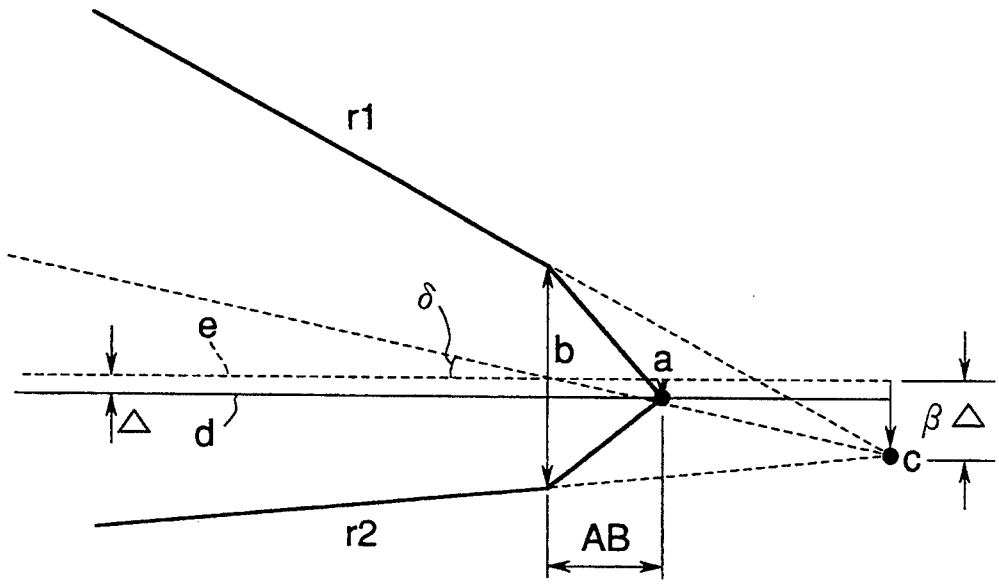
FIG. 7 is an optical sectional view corresponding to one of a series of drawings for explaining the principle of the illumination device according to the first aspect of the present invention, and showing a case wherein the Fresnel lens is only shifted.
Figure 8:
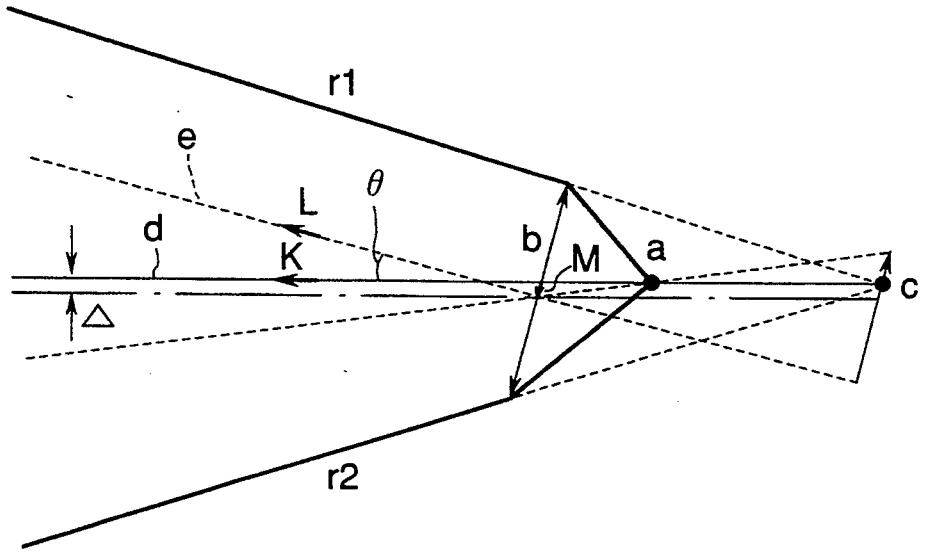
FIG. 8 is an optical sectional view corresponding to one of a series of drawings for explaining the principle of the illumination device according to the first aspect of the present invention, and showing a case wherein the Fresnel lens is tilted and shifted.

FIG. 3 is an optical sectional view showing the optical paths of rays emitted from the xenon tube in the illumination device of this embodiment. FIG. 4 is an optical sectional view showing the optical paths of rays emitted from the,xenon tube in a conventional illumination device in which the Fresnel lens is neither tilted nor shifted.

The illumination device of this embodiment is designed to be able to substantially compensate an offset due to tilt by that due to shift. Therefore, as shown in FIG. 3, rays emitted from the xenon tube 11 can satisfactorily illuminate an object without being substantially offset from the reference optical axis 21. In this manner, according to this embodiment, although the lens optical axis 23 of the Fresnel lens as the refraction means is tilted from the reference optical axis 21, substantially even illumination can be realized as in the conventional device in which the Fresnel lens is not tilted at all, as shown in FIG. 4.

In Examples 1 and 2 to be described below, dimensionless reference values will be verified in cases wherein various parameters of the illumination device have exemplary, values.

EXAMPLE 1

The values of parameters specified in Example 1 are as follows:

A=6.00 mm
B=3.00 mm
R=3.00 mm
d=2,000 mm (central thickness of Fresnel lens)
f=38.000 mm
r=18,661 mm (paraxial radius of curvature of Fresnel lens)
n=1.491 (refractive index of Fresnel lens to d-line)

Shape data of the Fresnel lens are as follows. Note that H is the height of the Fresnel lens from the optical axis, and $\theta$ is the angle defined between the Fresnel surface of the Fresnel lens and a plane perpendicular to the lens optical axis at the point of the height H.

TABLE 1

| H (mm) | $\theta$ (°) |
|---|---|
| 1.75 | 5.35 |
| 2.75 | 8.34 |
| 3.75 | 11.24 |
| 4.75 | 14.03 |
| 5.75 | 16.68 |
| 6.75 | 19.18 |

TABLE 1-continued

| H (mm) | θ (°) |
|---|---|
| 7.75 | 21.51 |
| 8.75 | 23.67 |
| 9.75 | 25.68 |

When the lens optical axis was tilted clockwise in FIG. 1 by the angle θ from the reference optical axis, the distance Δ (the distance of the lens center shifted downward in FIG. 1 from the reference optical axis) corresponding to a shift amount (the distance between the lens intersection and the lens center) required for compensating the offset of the illumination direction due to this tilt was as follows:

$\theta=12.7°$ $\Delta=2.7$ mm

The value of the dimensionless reference value introduced in the present invention was as follows:

$$|M|\cdot(L\cdot K)/f=0.07$$

As described above, it was confirmed that the dimensionless reference value fell within a range between the upper- and lower-limit values specified in the above description.

EXAMPLE 2

The values of parameters specified in Example 1 are as follows:

A=5.00 mm
B=3.00 mm
R=3.00 mm
d=1.500 mm
f=19.200 mm
r=9.429 mm
n=1.491

Shape data of the Fresnel lens are as follows.

TABLE 2

| H (mm) | θ (°) |
|---|---|
| 1.00 | 3.84 |
| 1.80 | 9.53 |
| 2.60 | 13.96 |
| 3.40 | 18.04 |
| 4.20 | 21.72 |
| 5.00 | 24.97 |

When the lens optical axis was tilted clockwise in FIG. 1 by the angle θ from the reference optical axis, the distance Δ (the distance of the lens center shifted downward in FIG. 1 from the reference optical axis) corresponding to a shift amount (the distance between the lens intersection and the lens center) required for compensating the offset of the illumination direction due to this tilt was as follows:

$\theta=12.0°$ $\Delta=2.0$ mm

The value of the dimensionless reference value introduced in the present invention was as follows:

$$|M|\cdot(L\cdot K)/f=0.10$$

As described above, it was confirmed that the dimensionless reference value fell within a range between the upper- and lower-limit values.

As described above, in the illumination device according to the first aspect of the present invention, even when the lens optical axis is tilted from the reference optical axis of the illumination device, the offset γ due to tilt can be substantially compensated by the offset δ due to shift by appropriately shifting the lens center from the reference optical axis according to the present invention. For this reason, the illumination range of a phototaking lens can be evenly and satisfactorily illuminated. As a result, limitations on design of a camera main body and, especially, the front surface of the camera, can be remarkably relaxed.

An embodiment according to the second aspect of the present invention will be described below.

Figure 9:
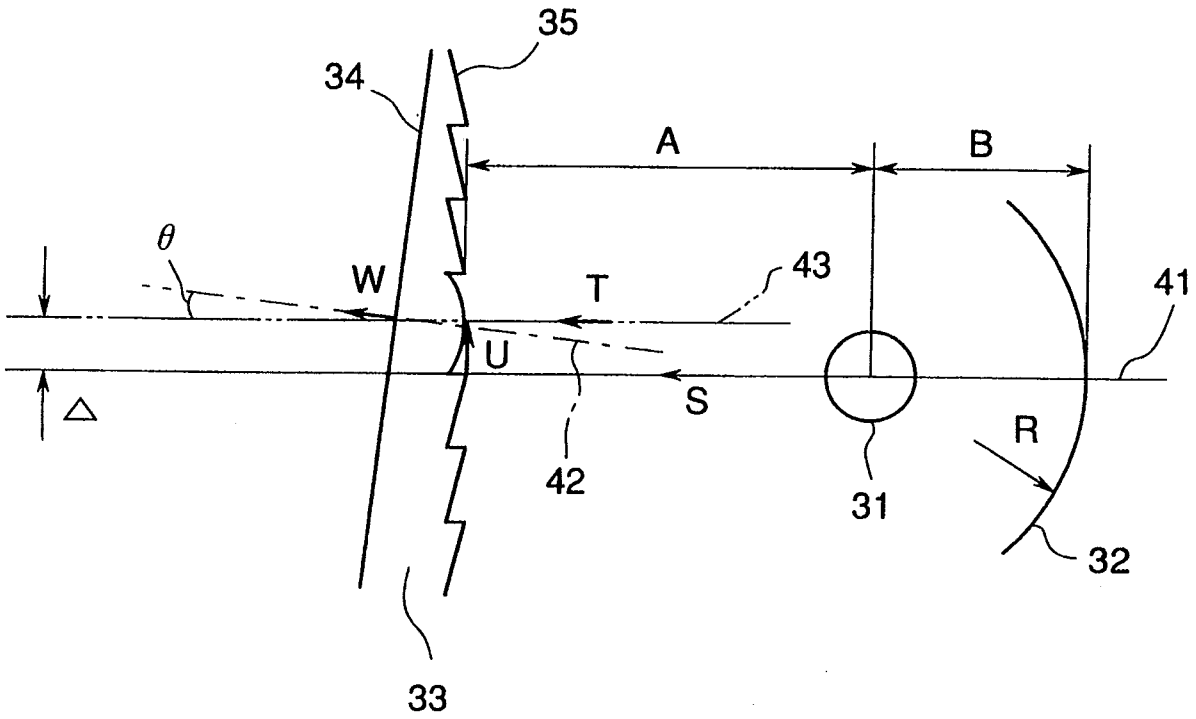
FIG. 9 is a view for explaining the arrangement of an illumination device according to an embodiment of the second aspect of the present invention.

FIG. 9 is a view for explaining the arrangement of an illumination device according to an embodiment of the second aspect of the present invention.

The illumination device of the present invention comprises, e.g., a xenon tube 31 as flash light means for emitting flash light. A reflector 32 for reflecting a light beam radiated from the xenon tube 31 is arranged on a side opposite to an object with respect to the xenon tube 31. The reflector 32 has a shape like a portion of a cylinder with a radius of curvature R, and is separated by a distance B from the center of the xenon tube 31.

A Fresnel lens 33 as refraction means for projecting a light beam directly radiated from the xenon tube 31 and a light beam reflected by the reflector 32 is arranged on the object side with respect to the xenon tube 31. The optical axes of the xenon tube 31 and the reflector 32 are coaxial with each other, and define a reference optical axis 41 of the illumination device.

The Fresnel lens 33 has a rotation-symmetrical shape with respect to its lens optical axis 43, a surface, facing the xenon tube 31, of the Fresnel lens is a Fresnel surface 35, and the other surface is a flat surface 34. The distance between a Fresnel intersection and the center of the xenon tube 31 along the reference optical axis 41 is A.

The lens optical axis 43 of the Fresnel lens 33 is shifted downward (FIG. 9) by a distance Δ from the reference optical axis 41. Also, an axis 42 indicating the direction of a normal vector W to the flat surface 34 of the Fresnel lens 33 is tilted clockwise in FIG. 9 by an angle θ from the lens optical axis 43.

Of light beams emitted from the xenon tube 31, a light beam propagating in a direction opposite to an object is reflected by the reflector 32 in the direction of the object, is refracted by the Fresnel lens 33, and illuminates the object. On the other hand, of light beams emitted from the xenon tube 31, a light beam propagating in the direction of the object is directly incident on the Fresnel lens 33, is refracted by the Fresnel lens 33, and illuminates the object.

Figure 10:
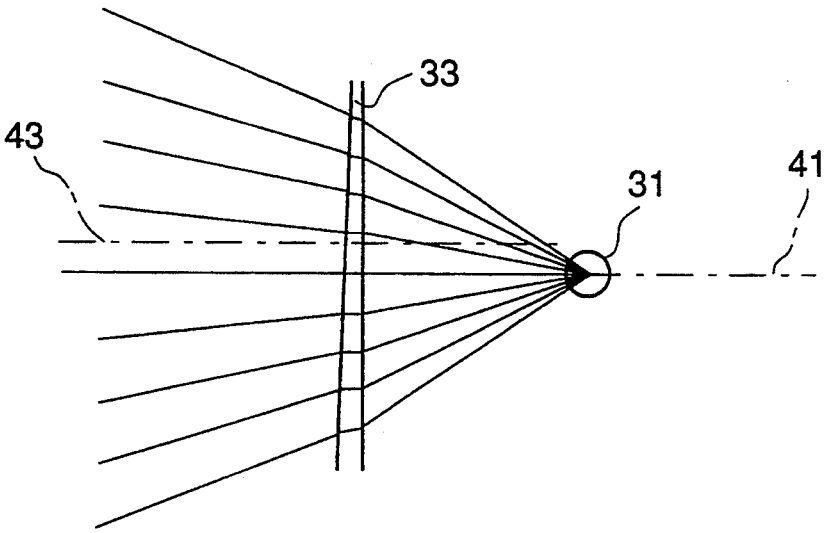
FIG. 10 is an optical sectional view showing the optical paths of rays emitted from a xenon tube in the illumination device of the embodiment shown in FIG. 9.
Figure 11:
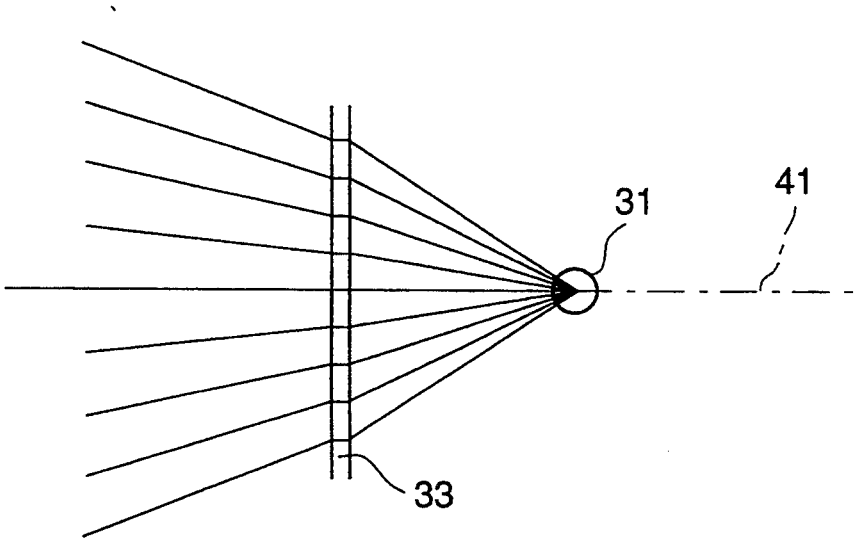
FIG. 11 PRIOR ART
FIG. 11 is an optical sectional view showing the optical paths of rays emitted from a xenon tube in a conventional illumination device in which a Fresnel lens is neither tilted nor shifted.
Figure 12:
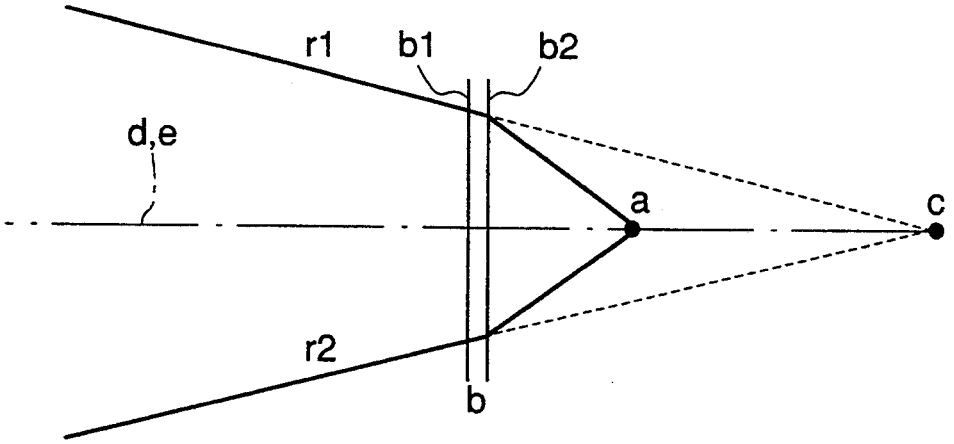
FIG. 12 is an optical sectional view corresponding to one of a series of drawings for explaining the principle of an illumination device according to the second aspect of the present invention, and showing a case wherein a Fresnel lens is neither tilted nor shifted.
Figure 13:
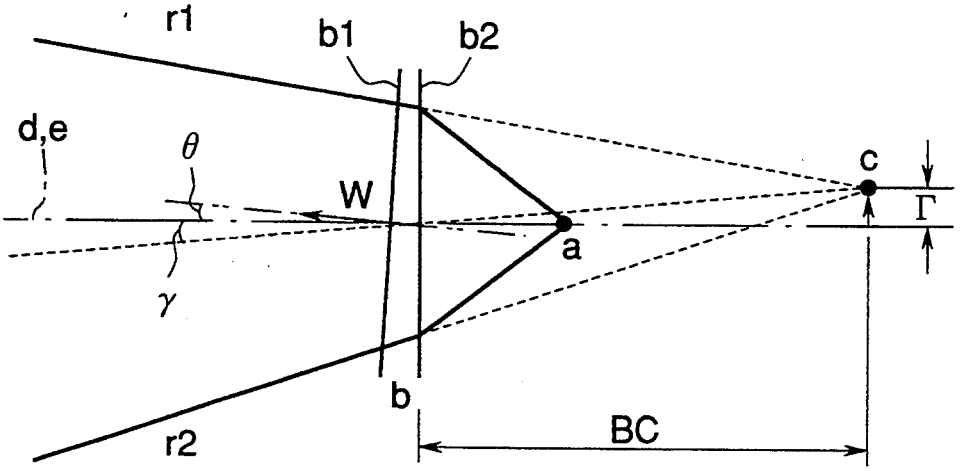
FIG. 13 is an optical sectional view corresponding to one of a series of drawings for explaining the principle of the illumination device according to the second aspect of the present invention, and showing a case wherein the Fresnel lens is only tilted.
Figure 14:
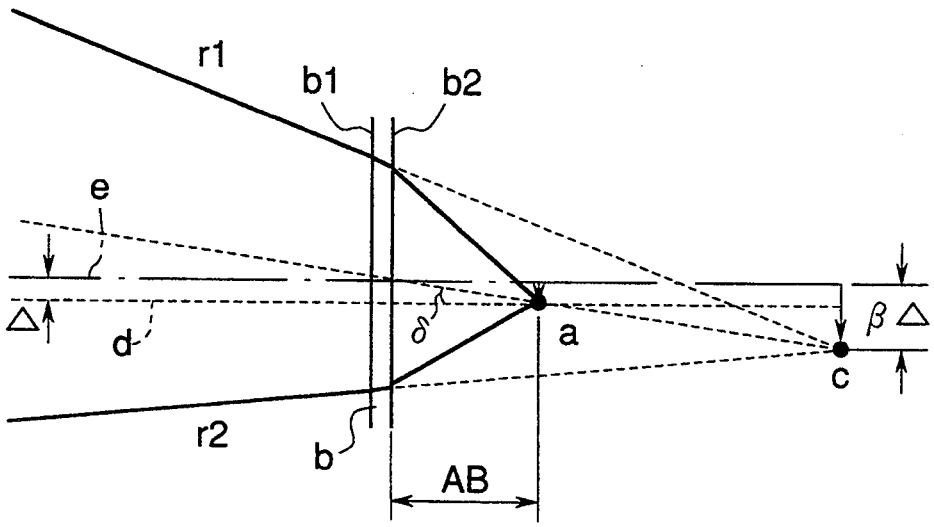
FIG. 14 is an optical sectional view corresponding to one of a series of drawings for explaining the principle of the illumination device according to the second aspect of the present invention, and showing a case wherein the Fresnel lens is only shifted.
Figure 15:
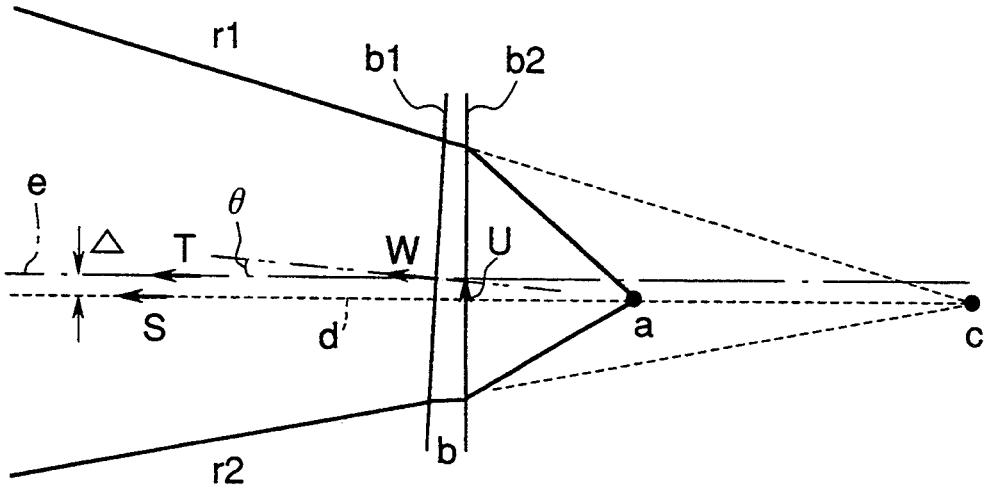
FIG. 15 is an optical sectional view corresponding to one of a series of drawings for explaining the principle of the illumination device according to the first aspect of the present invention, and showing a case wherein the Fresnel lens is tilted and shifted.
Figure 16:
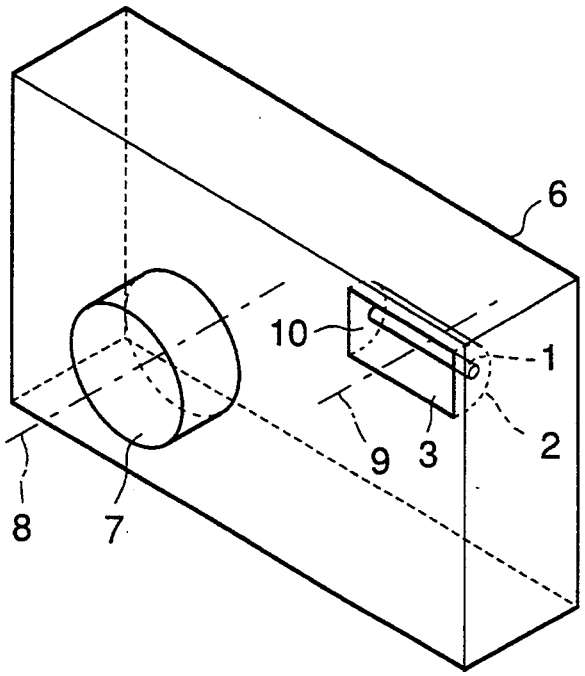
FIG. 16 PRIOR ART
FIG. 16 is a schematic perspective view showing the arrangement of a camera comprising a conventional illumination device.
Figure 17:
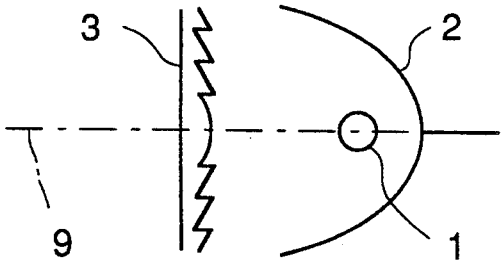
FIG. 17 PRIOR ART
FIG. 17 is a schematic sectional view showing the arrangement of the illumination device shown in FIG. 16.

FIG. 10 is an optical sectional view showing the optical paths of rays emitted from the xenon tube in the illumination device of this embodiment. FIG. 11 is an optical sectional view showing the optical paths of rays emitted from the xenon tube in a conventional illumination device in which the Fresnel lens is neither tilted nor shifted.

The illumination device of this embodiment is designed to be able to substantially compensate an offset due to tilt by that due to shift. Therefore, as shown in FIG. 10, rays emitted from the xenon tube 31 can satisfactorily illuminate an object without being substantially offset from the reference optical axis 41. In this manner, according to this embodiment, although the flat surface 34 of the Fresnel lens 33 as the refraction means is tilted from a plane perpendicular to the lens optical axis 43, substantially even illumination can be realized as in the conventional device in which the Fresnel lens is not tilted at all, as shown in FIG. 11.

In Examples 3 and 4 to be described below, dimensionless reference values will be verified in cases wherein various parameters of the illumination device have exemplary values.

EXAMPLE 3

The values of parameters specified in Example 3 are as follows:

A=6.00 mm
B=3.00 mm
R=3.00 mm
d=2.000 mm (central thickness of Fresnel lens)
f=38.000 mm
r=18.661 mm (paraxial radius of curvature of Fresnel lens)
n=1.491 (refractive index of Fresnel lens to d-line)

Shape data of the Fresnel lens are as follows. Note that H is the height of the Fresnel lens from the optical axis, and $\theta$ is the angle defined between the Fresnel surface of the Fresnel lens and a plane perpendicular to the lens optical axis at the point of the height H.

TABLE 3

| H (mm) | $\theta$ (°) |
|---|---|
| 1.75 | 5.35 |
| 2.75 | 8.34 |
| 3.75 | 11.24 |
| 4.75 | 14.03 |
| 5.75 | 16.68 |
| 6.75 | 19.18 |
| 7.75 | 21.51 |
| 8.75 | 23.67 |
| 9.75 | 25.68 |

When the flat surface of the Fresnel was tilted clockwise in FIG. 9 by the angle $\theta$ from the plane perpendicular to the lens optical axis, a shift amount (the distance of the lens optical axis from the reference optical axis) $\Delta$ required for compensating the offset of the illumination direction due to this tilt was as follows:

$\theta=9.0°$
$\Delta=4.0$ mm

The value of the dimensionless reference value introduced in the present invention was as follows:

$$|U|\cdot(W\cdot S)/f=0.104$$

As described above, it was confirmed that the dimensionless reference value fell within a range between the upper- and lower-limit values.

EXAMPLE 4

The values of parameters specified in Example 4 are as follows:

A=5.00 mm
B=3.00 mm
R=3.00 mm
d=2.000 mm
f=19.200 mm
r=9.429 mm
n=1.491

Shape data of the Fresnel lens are as follows.

TABLE 4

| H (mm) | $\theta$ (°) |
|---|---|
| 1.00 | 3.84 |
| 1.80 | 9.53 |
| 2.60 | 13.96 |
| 3.40 | 18.04 |
| 4.20 | 21.72 |
| 5.00 | 24.97 |

When the flat surface of the Fresnel was tilted clockwise in FIG. 9 by the angle $\theta$ from the plane perpendicular to the lens optical axis, a shift amount (the distance of the lens optical axis from the reference optical axis) $\Delta$ required for compensating the offset of the illumination direction due to this tilt was as follows:

$\theta=12.0°$
$\Delta=2.6$ mm

The value of the dimensionless reference value introduced in the present invention was as follows:

$$|U|\cdot(W\cdot S)/f=0.132$$

As described above, it was confirmed that the dimensionless reference value fell within a range between the upper- and lower-limit values.

As described above, in the illumination device according to the second aspect of the present invention, even when the flat surface of the Fresnel lens is tilted from the plane perpendicular to the lens optical axis, the offset $\gamma$ due to tilt can be substantially compensated by the offset $\delta$ due to shift by appropriately shifting the lens center from the reference optical axis according to the present invention. For this reason, the illumination range of a phototaking lens can be evenly and satisfactorily illuminated. As a result, limitations on design of a camera main body and, especially, the front surface of the camera, can be remarkably relaxed.

What is claimed is:

1. An illumination device comprising:

flash light means for radiating flash light;

reflection means, arranged on a side opposite to an object side with respect to said flash light means, for reflecting a light beam radiated from said flash light means, an optical axis of said reflection means and an optical axis of said flash light means being coaxial with each other, and defining a reference optical axis of said illumination device; and a Fresnel lens, arranged on the object side with respect to said flash light means, for projecting a light beam directly radiated from said flash light means and a light beam reflected by said reflection means toward an object, said Fresnel lens having a substantially rotation-symmetrical shape with respect to a lens optical axis thereof, a surface, on the object side, of said Fresnel lens being a flat surface perpendicular to the lens optical axis, and the other surface thereof being a Fresnel surface, wherein the lens optical axis is tilted by a predetermined angle from the reference optical axis, and a center of said Fresnel surface is shifted by a predetermined distance from a lens intersection as an intersection between the reference optical axis and said Fresnel surface, so that an offset of a light projection direction with respect to the reference optical axis due to the tilt of the lens optical axis is substantially compensated by an offset of the light projection direction with respect to the reference optical axis due to the shift of the lens center.

2. A device according to claim 1, wherein when a unit vector indicating a direction of the lens optical axis toward the object is represented by L, a unit vector indicating a direction of the reference optical axis toward the object is represented by K, a vector from the lens intersection to the lens center is represented by M, and a focal length of said Fresnel lens is represented by f, the vectors L, K, and M are present in a single plane, and the vectors L and M are perpendicular to each other, and a dimensionless value $|M|\cdot(L\cdot K)/f$, which is a reference value expressed by the parameters, and is obtained by dividing, with the focal length, a product of a magnitude $|M|$ of the vector M corresponding to the shift amount and an inner product $(L\cdot K)$ of the vectors L and K corresponding to the tilt amount, falls within a range defined between an upper-limit value for defining a limit beyond which the offset of the light projection direction due to the shift of the lens center becomes larger than the offset of the light projection direction due to the tilt of the lens optical axis, and a lower-limit value for defining a limit beyond which the offset of the light projection direction due to the tilt of the lens optical axis becomes larger than the offset of the light projection direction due to the shift of the lens center.

3. A device according to claim 2, wherein the upper-limit value is 0.2, and the lower-limit value is 0.03.

4. A device according to claim 1, wherein when a distance between the lens center and the reference optical axis is represented by H, and a focal length of said Fresnel lens is represented by f, said illumination device satisfies:

$0.03 \leqq H/f \leqq 0.2$

5. A device according to claim 1, wherein a reflection surface of said reflection means has a shape corresponding to a portion of a cylinder.

6. An illumination device comprising:

flash light means for radiating flash light;

reflection means, arranged on a side opposite to an object side with respect to said flash light means, for reflecting a light beam radiated from said flash light means, an optical axis of said reflection means and an optical axis of said flash light means being coaxial with each other, and defining a reference optical axis of said illumination device; and a Fresnel lens, arranged on the object side with respect to said flash light means, for projecting a light beam directly radiated from said flash light means and a light beam reflected by said reflection means toward an object, said Fresnel lens having a substantially rotation-symmetrical shape with respect to a lens optical axis thereof, a surface, on the object side, of said Fresnel lens being a flat surface titled by a predetermined angle from a plane perpendicular to the lens optical axis, and the other surface thereof being a Fresnel surface, wherein the lens optical axis is parallel to and is shifted by the predetermined distance from the reference optical axis, so that an offset of a light projection direction with respect to the reference optical axis due to the tilt of the flat surface, on the object side, of said Fresnel lens is substantially compensated by an offset of the light projection direction with respect to the reference optical axis due to the shift of the lens optical axis.

7. A device according to claim 6, wherein when a unit vector indicating a direction of the lens optical axis toward the object is represented by T, a unit vector indicating a direction of the reference optical axis toward the object is represented by S, a vector from a Fresnel intersection as an intersection between the Fresnel surface of said Fresnel lens and the reference optical axis to a Fresnel center as an intersection between the Fresnel surface of said Fresnel lens and the lens optical axis is represented by U, a unit normal vector passing a lens intersection as an intersection between the flat surface, on the object side, of said Fresnel lens and the lens optical axis, and indicating a normal to the flat surface, on the object side, of said Fresnel lens is represented by W, and a focal length of said Fresnel lens is represented by f, the vectors T and S are parallel to each other, the vectors T, W, and S are present in a single plane, and the vectors T and U are perpendicular to each other, and a dimensionless value $|U|\cdot(W\cdot S)/f$, which is a reference value expressed by the parameters, and is obtained by dividing, with the focal length, a product of a magnitude $|U|$ of the vector U corresponding to the shift amount and an inner product $(W\cdot S)$ of the vectors W and S corresponding to the tilt amount, falls within a range defined between an upper-limit value for defining a limit beyond which the offset of the light projection direction due to the shift of the lens optical axis becomes larger than the offset of the light projection direction due to the tilt of the flat surface, on the object side, of said Fresnel lens, and a lower-limit value for defining a limit beyond which the offset of the light projection direction due to the tilt of the flat surface, on the object side, of said Fresnel lens becomes larger than the offset of the light projection direction due to the shift of the lens optical axis.

8. A device according to claim 7, wherein the upper-limit value is 0.25, and the lower-limit value is 0.05.

9. A device according to claim 6, wherein a reflection surface of said reflection means has a shape corresponding to a portion of a cylinder.

* * * * *